US007762733B2

(12) United States Patent
Kakishima et al.

(10) Patent No.: US 7,762,733 B2
(45) Date of Patent: Jul. 27, 2010

(54) PRINTING APPARATUS, CONVEYANCE APPARATUS, AND FEED-CONVEYANCE CONTROL METHOD

(75) Inventors: Hiroyuki Kakishima, Kawasaki (JP); Shinya Sonoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 587 days.

(21) Appl. No.: 11/770,146

(22) Filed: Jun. 28, 2007

(65) Prior Publication Data

US 2008/0008513 A1 Jan. 10, 2008

(30) Foreign Application Priority Data

Jul. 6, 2006 (JP) ..... 2006-186977

(51) Int. Cl.
*B41J 11/42* (2006.01)
*B41J 29/38* (2006.01)
*B41J 13/26* (2006.01)

(52) U.S. Cl. ..... 400/76; 400/74; 400/630; 318/599

(58) Field of Classification Search ..... 400/74
See application file for complete search history.

(56) References Cited

U.S. PATENT DOCUMENTS

| | | | | |
|---|---|---|---|---|
| 6,805,425 | B2 | 10/2004 | Hayashi et al. | |
| 7,147,316 | B2 | 12/2006 | Hayashi et al. | |
| 7,165,765 | B2 | 1/2007 | Sonoda et al. | 271/122 |
| 7,193,380 | B2 * | 3/2007 | Stout et al. | 318/373 |
| 7,334,787 | B2 | 2/2008 | Akiyama et al. | |
| 2005/0175388 | A1 * | 8/2005 | Namekawa et al. | 400/625 |
| 2005/0275154 | A1 | 12/2005 | Sonoda | 271/122 |
| 2006/0033461 | A1 * | 2/2006 | Kakegawa et al. | 318/434 |
| 2006/0158502 | A1 | 7/2006 | Hayashi et al. | |
| 2006/0202655 | A1 * | 9/2006 | Shoji et al. | 318/626 |
| 2007/0023994 | A1 * | 2/2007 | Mandel et al. | 271/226 |

FOREIGN PATENT DOCUMENTS

| | | |
|---|---|---|
| JP | 60-070925 | 4/1985 |

(Continued)

OTHER PUBLICATIONS

Partial English translation of the Office Action dated Nov. 24, 2009, concerning Japanese Patent Application No. 2007-163021.

*Primary Examiner*—Daniel J Colilla
(74) *Attorney, Agent, or Firm*—Fitzpatrick, Cella, Harper & Scinto

(57) ABSTRACT

This invention relates to an apparatus and method capable of appropriately preventing a printing medium from being diagonally conveyed upon feed regardless of changes in printing medium feed conditions. In this invention, the maximum output value of a PWM signal is compared with the sum of a predetermined bias value and the PWM signal when a sensor detects the tip of a fed printing medium. If the sum is smaller than the maximum output value, it is monitored that the value of the PWM signal increases by the bias value. If the sum is equal to or larger than the maximum output value, it is monitored that the conveyance speed of the printing medium becomes smaller than a predetermined threshold value. Control is performed on the basis of the monitor results to stop driving a DC motor that supplies a driving force to rollers used for feed and conveyance.

10 Claims, 12 Drawing Sheets

FOREIGN PATENT DOCUMENTS

| | | | | |
|---|---|---|---|---|
| JP | 11043233 | A | * | 2/1999 |
| JP | 2002-347296 | | | 12/2002 |
| JP | 2003-266828 | | | 9/2003 |
| JP | 2003-291433 | | | 10/2003 |
| JP | 2005-074905 | | | 3/2005 |
| JP | 2006-0158502 | | | 7/2006 |

* cited by examiner

PRINTING APPARATUS, CONVEYANCE APPARATUS, AND FEED-CONVEYANCE CONTROL METHOD

BACKGROUND OF THE INVENTION

1. Field of the Invention

The present invention relates to a printing apparatus, conveyance apparatus, and conveyance control method. Particularly, the present invention relates to a printing apparatus and a feed-conveyance control method which supply a printing medium such as a printing paper sheet and print on the printing medium by causing a printhead to discharge ink.

2. Description of the Related Art

The following method is conventionally known to prevent a printing medium such as a printing paper sheet from being diagonally conveyed in a printing apparatus upon feed. A conveyance roller is stopped or rotated in a direction reverse to the conveyance direction of a printing medium. In this state, the printing medium is conveyed by a feed roller until its tip(leading edge) abuts against the conveyance roller. In this case, generally, after a printing medium position detection sensor provided immediately before the conveyance roller detects the tip position of the printing medium, the printing medium is conveyed by the feed roller by the distance from the sensor to the conveyance roller until its tip abuts against the conveyance roller.

Japanese Patent Laid-Open No. 2002-347296 discloses an arrangement that counts the number of times the duty value of a driving pulse signal by PWM (Pulse Width Modulation) has reached the maximum value. If the count value has reached a predetermined value, the duty value (to be described later) of PWM is switched to "0" to interrupt voltage application to a DC motor. This arrangement stops power supply to the DC motor to prevent heat generation in it if the DC motor is locked.

The technique described in this prior art presumes to determine abutting of the tip(leading edge) of a printing medium depending on whether or not the PWM duty value exceeds a predetermined threshold value. In this case, if feed conditions such as the type of printing medium, variations in conveyance mechanism load, and motor performance change, the timing when the duty value exceeds the threshold value also changes. For this reason, it is not able to properly prevent a printing medium from being diagonally conveyed.

FIG. 8 is a graph for explaining control for preventing diagonal conveyance by using a conventional technique.

In this conventional technique, when an output PWM value exceeds a predetermined threshold value, conveyance is stopped by setting the value (PWM along the ordinate in FIG. 8) to "0". The abutting detection timing changes as indicated by $\Delta X$ in FIG. 8 depending on the output PWM value before abutting against a conveyance roller. This may make it impossible to prevent a printing medium from being diagonally conveyed or wrinkle a printing medium due to overabutting.

SUMMARY OF THE INVENTION

Accordingly, the present invention is conceived as a response to the above-described disadvantages of the conventional art.

For example, a printing apparatus, a conveyance apparatus, and a feed-conveyance control method according to this invention are capable of appropriately preventing a printing medium from being diagonally conveyed upon feed regardless of changes in printing medium feed conditions.

According to one aspect of the present invention, preferably, there is provided a printing apparatus which feeds a stacked printing medium, conveys the printing medium to a print start position, and causes a printhead to print on the printing medium, comprising: a first roller which feeds the printing medium from a stacking position of the printing medium into the apparatus; a second roller which further conveys the printing medium fed by the first roller to the print start position; a DC motor which supplies a driving force to the first roller and the second roller; an encoder which detects a rotation amount and rotational speed of the first roller; a sensor, provided at a predetermined position along a feed-conveyance path of the printing medium, for detecting a tip of the printing medium; generation means for generating a PWM signal by feeding back the rotation amount and rotational speed detected by the encoder; driving means for driving the DC motor by receiving the PWM signal; first monitor means for monitoring that a value of the PWM signal becomes larger than a predetermined value with respect to the value of the PWM signal obtained at a timing when the sensor detects the tip of the fed printing medium; and control means for controlling to stop driving the DC motor on the basis of a monitor result of the first monitor means.

According to another aspect of the present invention, preferably, there is provided a conveyance apparatus which feeds a stacked printing medium and conveys the printing medium to a predetermined first position, comprising: a first roller which feeds the printing medium from a stacking position of the printing medium into the apparatus; a second roller which conveys the printing medium fed by the first roller to the first position; a DC motor which supplies a driving force to the first roller and the second roller; an encoder which detects a rotation amount and rotational speed of the first roller; a sensor, provided at a second position along a feed-conveyance path of the printing medium, for detecting a tip of the printing medium; generation means for generating a PWM signal by feeding back the rotation amount and rotational speed detected by the encoder; driving means for driving the DC motor by receiving the PWM signal; monitor means for monitoring that a value of the PWM signal becomes larger than a predetermined value with respect to the value of the PWM signal obtained at a timing when the sensor detects the tip of the fed printing medium; and control means for controlling to stop driving the DC motor on the basis of a monitor result of the monitor means.

According to still another aspect of the present invention, preferably, there is provided a method of feeding a printing medium of stacked printing media from a stacked position via a first roller to which a driving force is supplied from a DC motor, and further conveying the printing medium fed by the first roller into a predetermined first position via a second roller to which a driving force is supplied from the DC motor, comprising: a first detection step of detecting a rotation amount and rotational speed of the first roller by using an encoder; a second detection step of detecting a tip of the printing medium by using a sensor provided at a second position along a feed-conveyance path of the printing medium; a generation step of generating a PWM signal by feeding back the rotation amount and rotational speed of the first roller detected by the encoder; a driving step of driving the DC motor by receiving the PWM signal; a monitor step of monitoring that a value of the PWM signal becomes larger than a predetermined value with respect to the value of the PWM signal obtained at a timing when the sensor detects the tip of the fed printing medium; and a control step of controlling to stop driving the DC motor on the basis of a monitor result in the monitor step.

The invention is particularly advantageous since stop control of a DC motor that supplies a driving force to rollers to feed or convey a printing medium is performed while monitoring a plurality of states, and it is therefore possible to appropriately prevent a printing medium from being diagonally conveyed upon feed in accordance with various feed conditions.

Further features of the present invention will become apparent from the following description of exemplary embodiments (with reference to the attached drawings).

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
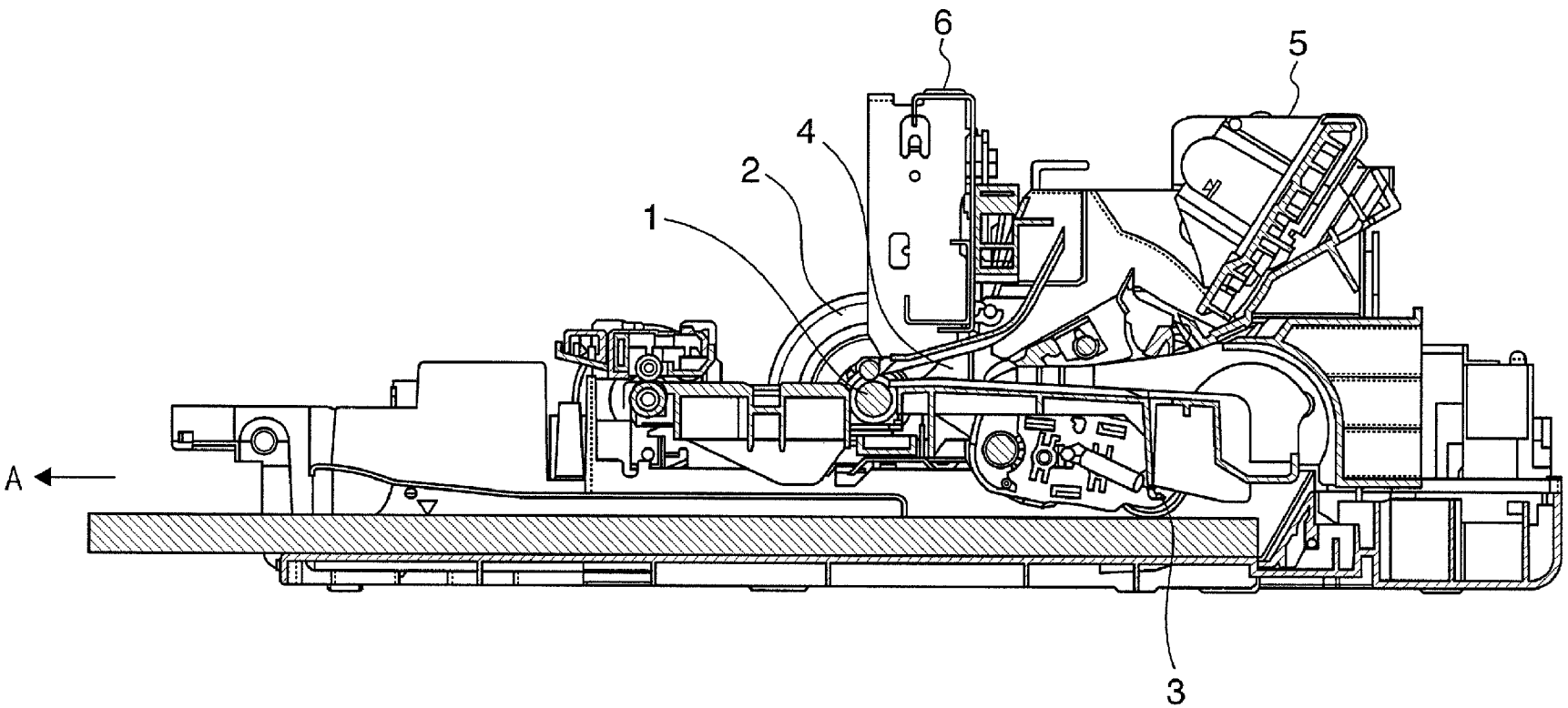
FIG. 1 is a side sectional view showing the schematic arrangement of an inkjet printing apparatus according to a typical embodiment of the present invention.

FIG. 1 is a side sectional view showing the mechanically driven part of a printing apparatus according to a typical embodiment of the present invention, which prints by using an inkjet printhead.

As shown in FIG. 1, a conveyance (LF) roller 1 conveys, in a direction of an arrow A, a printing medium (not shown) such as a printing paper sheet fed from an automatic sheet feeder (ASF) 5 via a feed roller 3. An inkjet printhead (not shown: to be referred to as a printhead hereinafter) mounted on a carriage 6 discharges ink droplets to the printing medium fed by the ASF 5 to execute printing. This printing is triggered by tip(leading edge) detection by a PE sensor 4 that detects the tip of a printing medium.

A rotary encoder (to be referred to as an encoder hereinafter) 2 to detect the position (rotation amount) and speed of the conveyance roller 1 is attached coaxially with the conveyance roller 1.

Figure 2:
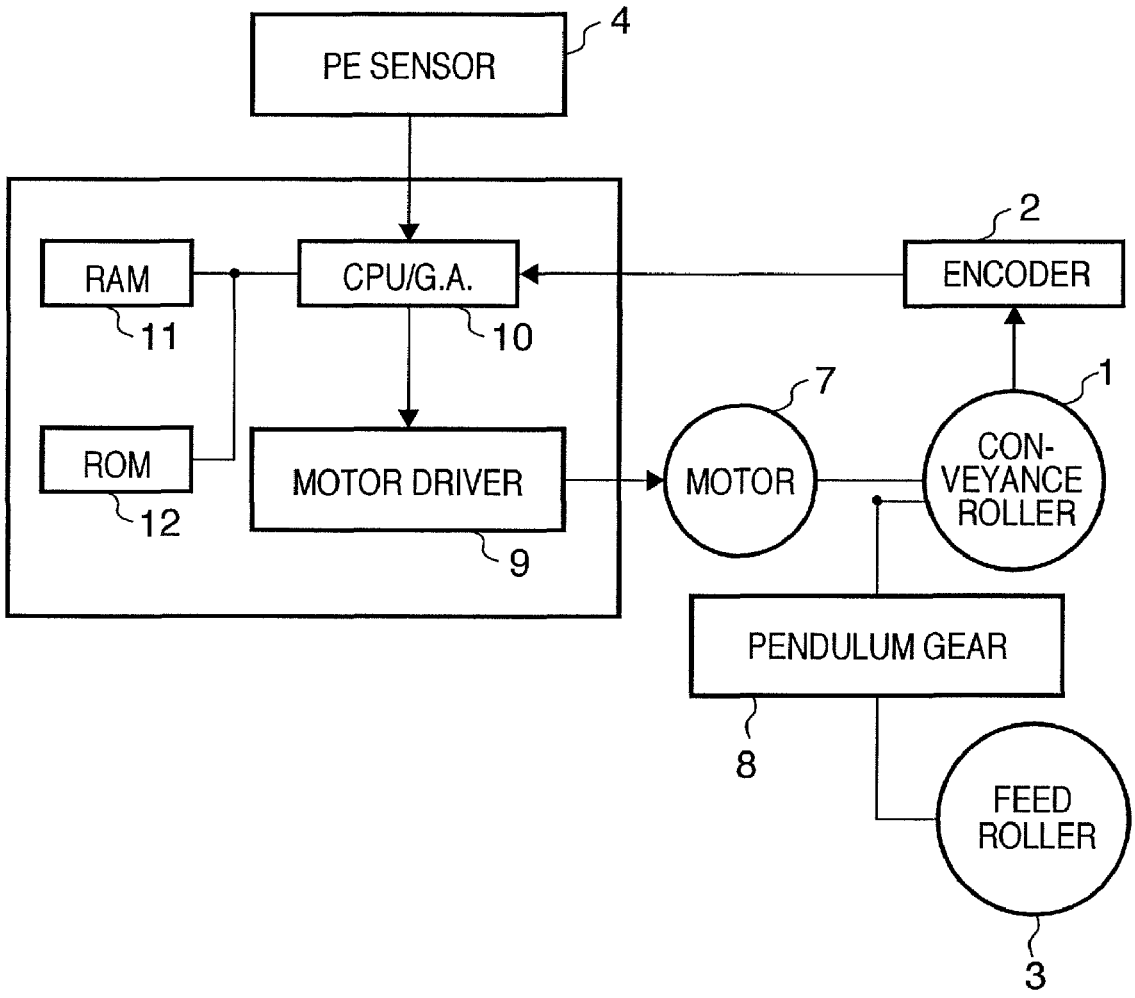
FIG. 2 is a block diagram showing the control arrangement of the printing apparatus shown in FIG. 1.

FIG. 2 is a block diagram showing the control arrangement of the printing apparatus shown in FIG. 1.

The conveyance roller 1 and feed roller 3 are rotated by a common motor 7 serving as a driving source. In this embodiment, the motor 7 transmits its driving force to the conveyance roller 1 directly but to the feed roller 3 via a pendulum gear 8. The motor 7 can rotate to convey the printing medium both in the direction of arrow A in FIG. 1 (forward rotation) and in a direction reverse to the arrow A (reverse rotation). A CPU/G.A. (Gate Array) 10 gives an instruction about the rotation direction to the motor 7 through a motor driver 9. A DC motor is employed as the motor 7, and is PWM-controlled (to be described later) via the motor driver 9.

The motor 7 transmits its driving force to the feed roller 3 in the following way.

When the motor 7 rotates in the reverse direction, the pendulum gear 8 moves toward the feed roller 3 and engages with a gear attached to the rotating shaft of the feed roller 3. This transmits the driving force of the motor 7 to the feed roller 3. The feed roller 3 picks up a printing medium such as a printing paper sheet from the ASF 5 by the rotary power. When the pendulum gear 8 engages with the gear attached to the rotating shaft of the feed roller 3, and the DC motor is driven to rotate both the feed roller 3 and the conveyance roller 1. On the other hand, when the motor 7 rotates in the forward direction, the pendulum gear 8 is separated from the feed roller 3 and disengages from the gear attached to the rotating shaft of the feed roller 3. This stops transmitting the driving force of the motor 7 to the feed roller 3. If the pendulum gear 8 disengages from the gear attached to the rotating shaft of the feed roller 3, the DC motor is driven to rotate only the conveyance roller 1.

That is, the feed roller 3 rotates only when the motor 7 rotates in the reverse direction. When the motor 7 rotates in the reverse direction, the conveyance roller 1 rotates in a direction reverse to the normal conveyance direction (the direction of arrow A in FIG. 1) so as to abut the tip of the printing medium supplied by rotation of the feed roller 3 against the conveyance roller 1. This prevents a printing medium that is diagonally supplied from being diagonally conveyed.

Figure 10A:
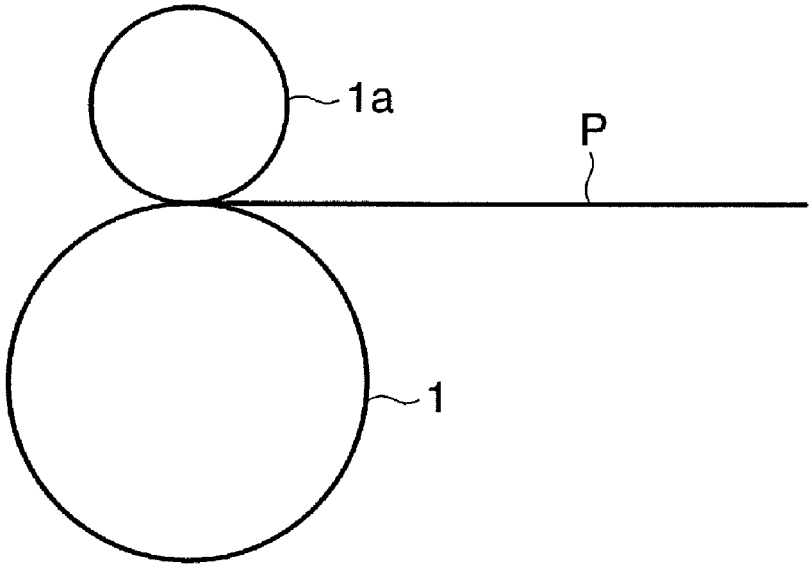
FIGS. 10A and 10B are views for explaining abutting.
Figure 10B:
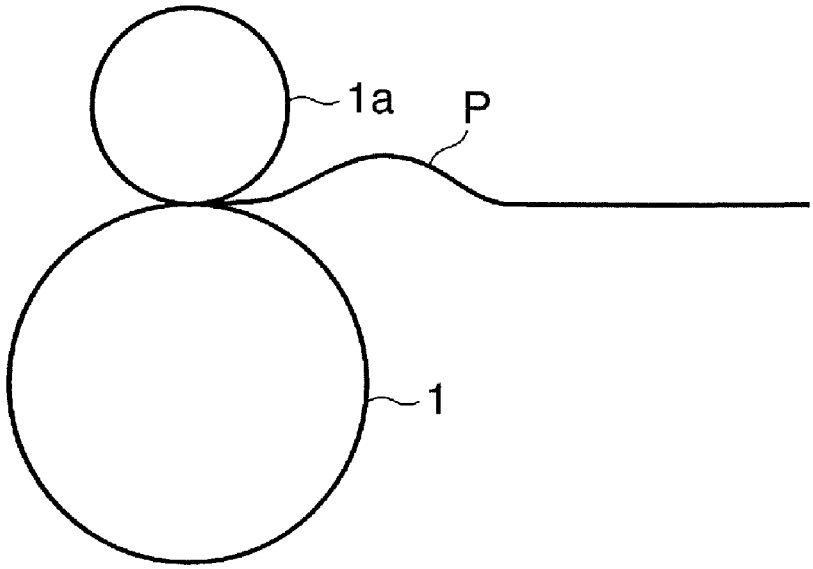

FIG. 10B shows a state where the tip of a printing medium P abuts against the conveyance roller 1. In this state, the tip of the paper sheet is located at the nip between the conveyance roller 1 and a pinch roller 1*a* so that the paper sheet P forms a bump.

The CPU/G.A. 10 controls the overall printing apparatus on the basis of control programs, various parameters, and speed driving patterns stored in a ROM 12 by using a RAM 11 as a work area for program execution. The CPU/G.A. 10 also executes an arithmetic process for PWM control. The RAM 11 also serves as a buffer to store image data transferred from an external device (not shown) such as a personal computer or digital camera.

The CPU/G.A. 10 receives the output from the encoder 2 and, on the basis of it, obtains the rotational speed and amount of the conveyance roller 1 and those of the feed roller 3.

In a case where the pendulum gear 8 transmits the driving force of the DC motor to the feed roller 3, the gear ratio of transmission means provided between the feed roller 3 and the conveyance roller 1 is known in advance. Thus, it is possible to derive, on the basis of the gear ratio, the rotation amount of the feed roller 3 from that of the conveyance roller 1 and the rotational speed of the feed roller 3 from that of the conveyance roller 1.

Upon controlling to rotate the feed roller 3, the CPU/G.A. 10 can acquire the information of the rotation amount and speed of the feed roller 3 by using the signal from the encoder 2 provided on the rotating conveyance roller 1. The CPU/G.A. 10 acquires information indirectly from the encoder 2 provided on the conveyance roller 1, thereby controlling rotation of the feed roller 3.

Figure 3:
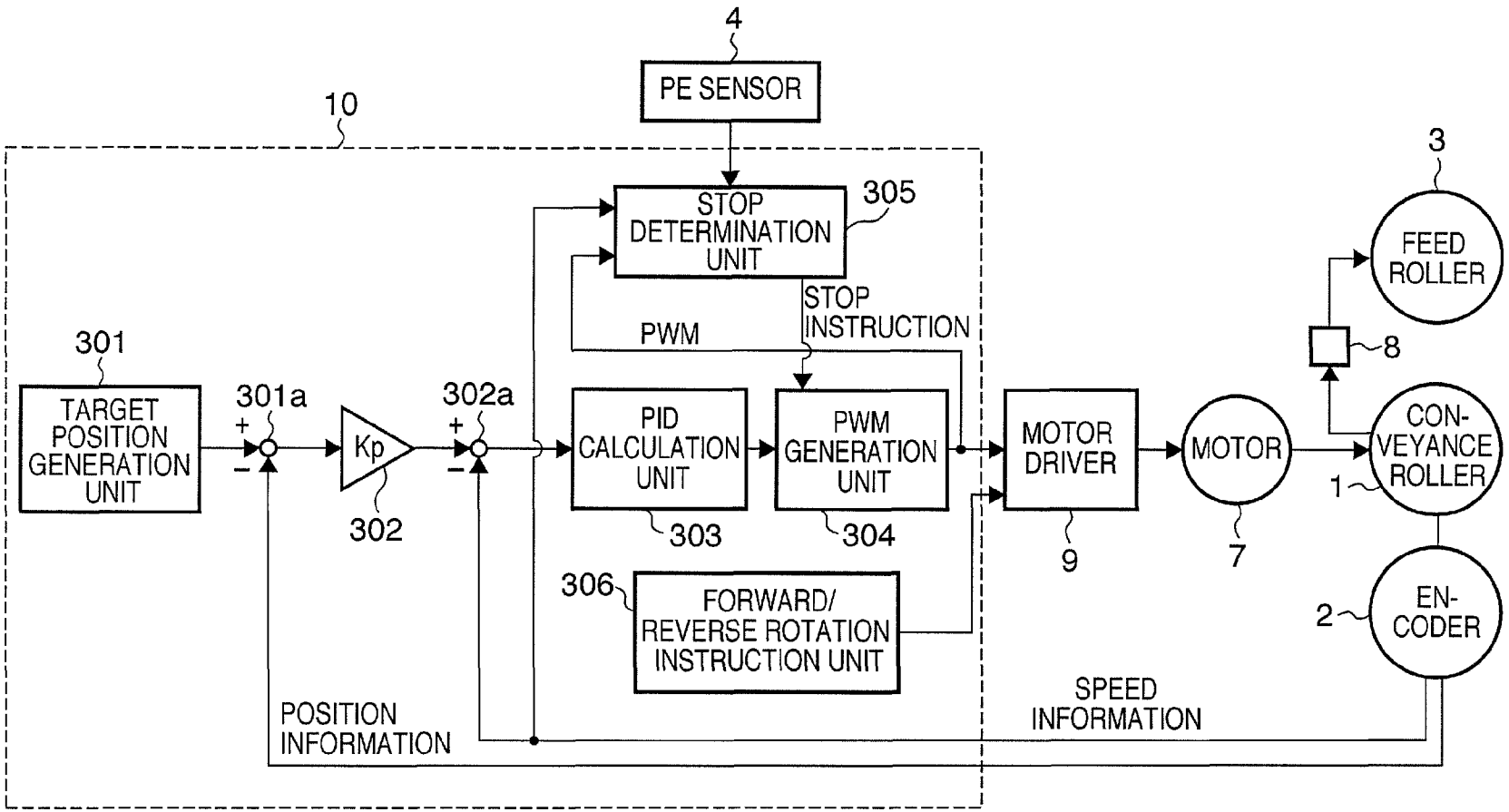
FIG. 3 is a block diagram showing an example of the functional arrangement of servo control of a motor that drives a conveyance roller and a feed roller.

FIG. 3 is a block diagram showing the functional arrangement of servo control of the motor that drives the conveyance roller and the feed roller.

The servo control function according to this embodiment is implemented by an ASIC (not shown) incorporated in the CPU/G.A. 10 and by executing a control program stored in the ROM 12 in the CPU/G.A. 10. The constituent elements in an area indicated by the broken line in FIG. 3 correspond to functions implemented by the program or ASIC. The servo control process is repeatedly performed in every servo period (ΔT).

A target position generation unit 301 generates a target position that progressively increases to a final target position (e.g., the print start position of a printing paper sheet) by servo control. The rotational speed and rotation amount of the conveyance roller are obtained from the output from the encoder 2. They correspond to the conveyance speed of the printing medium and the conveyance position of (the tip of) the printing medium, respectively. This calculation is well-known, and a description thereof will be omitted. The information about the conveyance speed and conveyance position is fed back to the CPU/G.A. 10.

More specifically, the position information is fed back to adder 301*a* to combine with the target position from the target position generation unit 301 position generation unit 301 at an adder 301*a* the speed information is fed back to adder 302*a* to combine with the target speed from the differentiating circuit 302. The speed information is also fed back to a stop determination unit 305 and used to determine whether to stop the motor 7.

A PWM (Pulse Width Modulation) signal is calculated through a PID calculation unit 303 and a PWM generation unit 304 on the basis of the speed corrected by the speed information from the encoder 2 and output to the motor driver 9. An instruction from a forward/reverse rotation instruction unit 306 is also output to the motor driver 9. The motor driver 9 drives the motor 7 on the basis of the PWM signal generated by the PWM generation unit 304 and the forward/reverse rotation instruction output from the forward/reverse rotation instruction unit 306. The PWM signal is represented by a duty value (the ratio of high level and low level, i.e., the ratio of ON and OFF of a pulse signal during a predetermined time). The duty value ranges from 0% to 100%. The larger the duty value becomes, the larger the power supplied to the motor becomes.

In addition to the speed information fed back from the encoder 2, the stop determination unit 305 also receives the PWM signal from the PWM generation unit 304 and a sensor output signal from the PE sensor 4. The stop determination unit 305 outputs a stop instruction to the PWM generation unit 304 on the basis of these signals.

Figure 4:
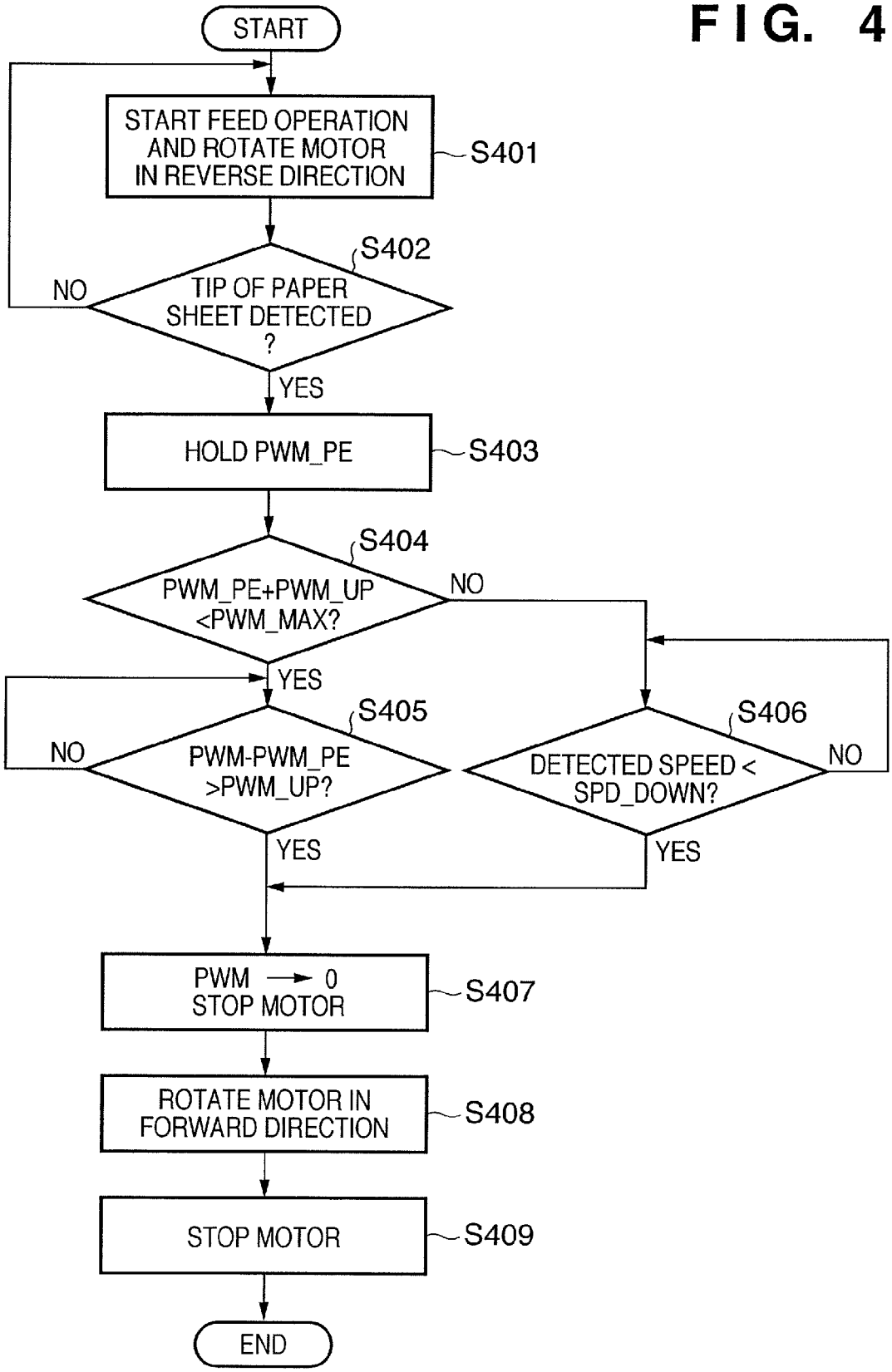
FIG. 4 is a flowchart illustrating motor control executed by a CPU/G.A.

FIG. 4 is a flowchart illustrating motor control executed by the CPU/G.A. 10.

In step S401, a feed operation starts, and the forward/reverse rotation instruction unit 306 outputs a reverse rotation instruction to the motor driver 9. The motor 7 rotates in the reverse direction. The pendulum gear 8 engages with the gear of the feed roller 3. The feed roller 3 rotates to pick up and feed one printing paper sheet stacked on the ASF 5. The conveyance roller 1 also rotates as the motor 7 rotates. However, the rotation direction is reverse to the arrow A in FIG. 1.

When the printing paper sheet is fed by rotation of the feed roller 3, it is checked in step S402 on the basis of the output from the PE sensor 4 whether or not the tip of the paper sheet is detected. If it is determined that the tip of the paper sheet is detected, the process advances to step S403. If it is determined that the tip of the paper sheet has not been detected yet, the process returns to step S401 to continuously rotate the feed roller 3 and go on feeding the printing paper sheet. After the servo period (ΔT), the process in step S402 is executed again.

In step S403, a PWM value (PWM_PE) upon tip detection by the PE sensor 4 is acquired and temporarily stored in a memory or register (not shown).

In step S404, it is checked whether or not a value obtained by adding a first threshold value (PWM_UP) to the PWM value upon tip detection is smaller than an upper limit value (PWM_MAX) of the PWM signal generated by the PWM generation unit 304. The first threshold value (PWM_UP) is used for determining an increase in PWM after tip detection.

If PWM_PE+PWM_UP<PWM_MAX, the process advances to step S405. In step S405, the process waits until the current PWM value (PWM) increases from the value upon tip detection by the first threshold value (PWM_UP). In the abutting operation by the feed roller 3, the tip of the paper sheet reaches the nip between the conveyance roller 1 and the pinch roller 1*a*, as shown in FIG. 10A, and then, the paper sheet P forms a bump, as shown in FIG. 10B. In this process, the PWM value increases (becomes large).

That is, if PWM−PWM_PE>PWM_UP, the process advances to step S407. If PWM−PWM_PE≦PWM_UP, the process in step S405 is executed again after the servo period (ΔT).

If PWM_PE+PWM_UP≧PWM_MAX, the PWM value upon tip detection is approaching the output upper limit value of the PWM signal. It is therefore determined that determining an increase in PWM after tip detection is not appropriate, and the process advances to step S406. This might occur when the load on the mechanically driven portion of the printing apparatus is heavy, and the motor 7 heats up due to the continuous printing operation and the output torque in the motor 7 decreases.

In step S406, the process waits until the printing paper sheet conveyance speed (detected speed) detected by the encoder 2 becomes lower than a predetermined speed (SPD_DOWN). In this embodiment, SPD_DOWN is set to a speed slightly lower than the target speed (e.g., 90% of the target speed). If detected speed<SPD_DOWN, the process advances to step S407. If detected speed≧SPD_DOWN, the process in step S406 is executed again after the servo period (ΔT).

In step S407, the PWM is set to "0" (0%) to stop the feed roller 3. In other words, the stop determination unit 305 issues a stop instruction to the PWM generation unit 304.

Figure 5:
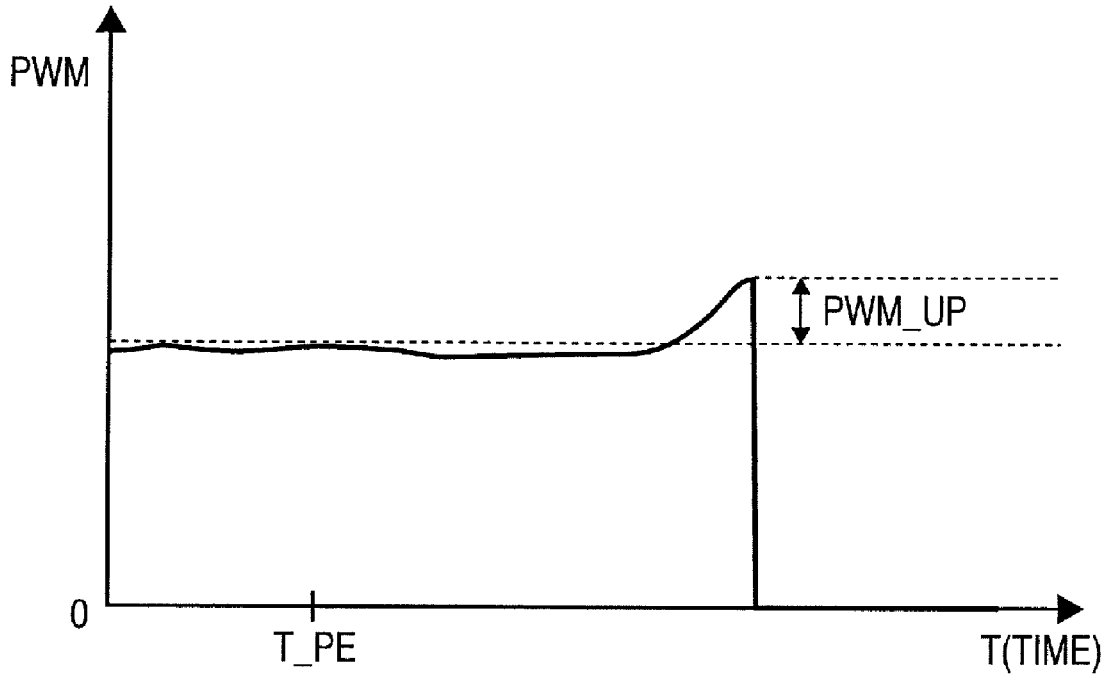
FIG. 5 is a graph showing a time variation in PWM signal.

FIG. 5 is a graph showing a time variation in PWM signal.

FIG. 5 particularly shows changes in PWM in steps S402 to S405 and S407. Referring to FIG. 5, T_PE indicates a tip detection time. According to FIG. 5, control is performed to set the PWM signal to "0" when the PWM increases by the first threshold value (PWM_UP) after tip detection.

Figure 6:
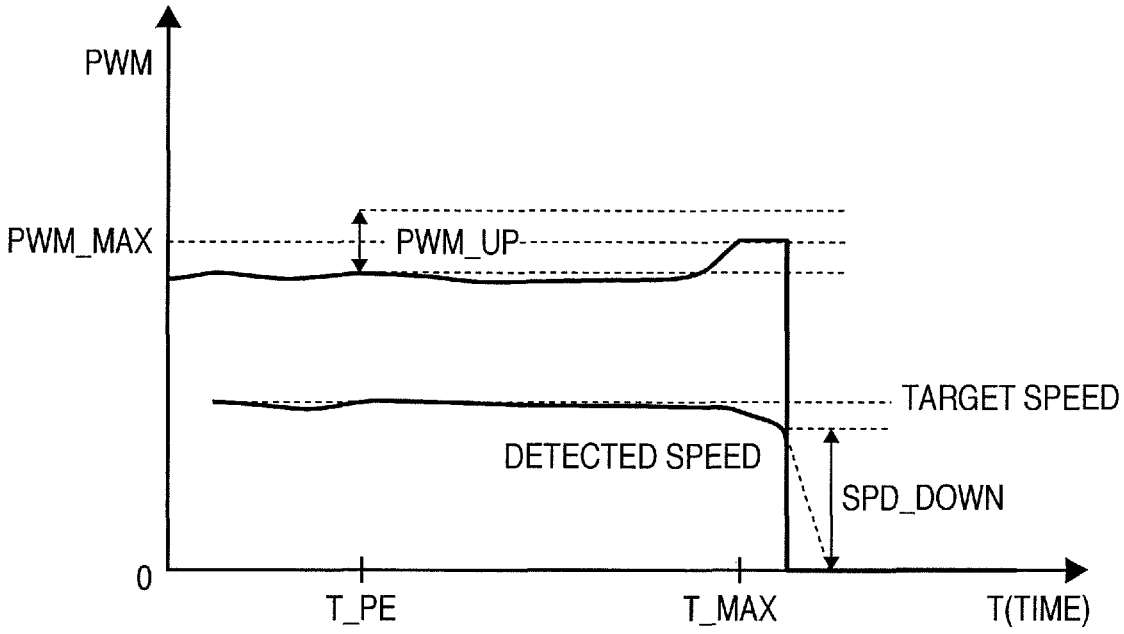
FIG. 6 is a graph showing a time variation in PWM signal and detection speed.

FIG. 6 is a graph showing a time variation in PWM signal and detected speed.

FIG. 6 particularly shows changes in PWM and detected speed in steps S402 to S404, S406, and S407. Referring to FIG. 6, T_PE also indicates a tip detection time. According to FIG. 6, after the tip detection time, the PWM reaches the upper limit value (PWM_MAX) at a time T=T_MAX. Then, PWM_MAX is maintained. The upper limit value of PWM is 100%. On the other hand, control is performed to set the PWM signal to "0"; when the detected speed starts falling below the target speed and drops below SPD_DOWN. The broken line indicates an expected speed in a case where the PWM signal is not "0".

The above-described process will be summarized. Upon detecting that the PWM signal output increases from that at the time of tip detection by a predetermined amount, it is determined that the tip of the paper sheet has abut against the conveyance roller, and the motor is stopped. On the other hand, if the PWM signal output upon tip detection is close to the upper limit value, the decrease in speed is detected. Then, stop conveying the printing paper sheet is determined, and the motor is stopped.

After that, in step S408, the forward/reverse rotation instruction unit 306 issues a forward rotation instruction to the motor driver 9 to rotate the motor 7 again. At this time, the motor 7 rotates in the forward direction. The pendulum gear 8 is separated from the feed roller 3 so the driving force of the motor 7 is no longer transmitted to the feed roller 3. That is, the feed roller 3 remains stopping. At this point of time, the tip of the printing paper sheet already abuts against the conveyance roller 1. Hence, the conveyance roller 1 conveys the printing paper sheet in the direction of arrow A.

When the printing paper sheet reaches the print start position, driving of the motor 7 is stopped in step S409, thereby ending the series of feed operations.

Tip detection in step S402 and PWM signal output holding in step S403 may be executed at appropriate timings from the start of feed operation without being triggered by tip detection.

In step S407, control is performed to set the PWM value to "0". However, other control may be applicable. For example, the PWM value may gradually be decreased so as to take a longer time to stop conveying a printing paper sheet.

As described above, according to this embodiment, it is possible to determine, on the basis of a time variation in a value obtained by adding a predetermined bias value to a PWM signal after tip detection, that a printing medium has abut against the conveyance roller and stop feed by the feed roller. If the value exceeds the PWM maximum output value, it is possible to detect a decrease in printing medium conveyance speed and stop feed by the feed roller.

In this embodiment, control is performed to stop rotating the feed roller by combining a plurality of conditions. This allows to cope with various feed conditions. During the feed operation, the conveyance roller rotates in the direction reverse to the printing medium conveyance direction. Even though a printing medium is diagonally fed, it can be prevented from being diagonally conveyed upon further feeding of the printing medium. This allows to appropriately prevent a printing medium from being diagonally conveyed upon feed.

In the above-described embodiment, the stop determination unit issues a PWM signal output stop instruction to the PWM generation unit, as shown in FIG. 3. However, the present invention is not limited to this. For example, the stop determination unit may directly issue a stop instruction to the motor driver, as shown in FIG. 7.

Figure 7:
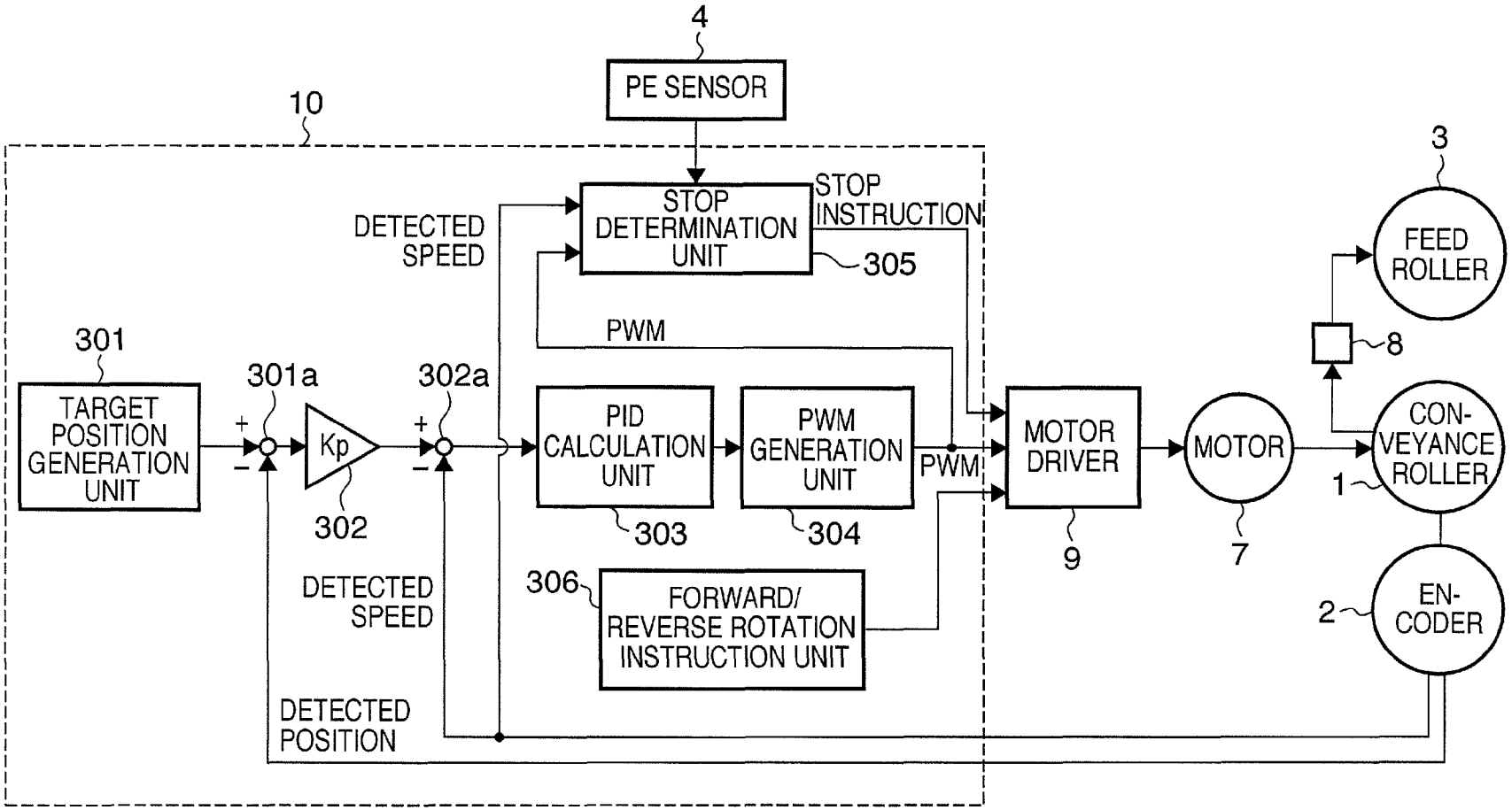
FIG. 7 is a block diagram showing another embodiment of the functional arrangement of servo control of a motor that drives a conveyance roller and a feed roller.
Figure 8:
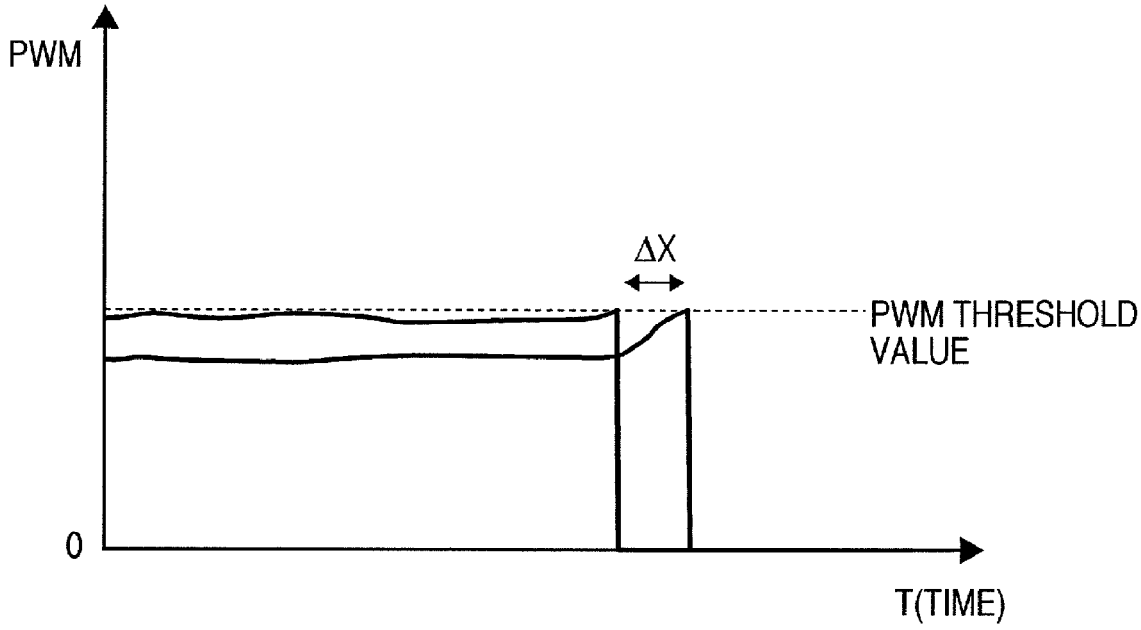
FIG. 8 is a graph for explaining diagonal conveyance prevention by using a conventional technique.

The arrangement shown in FIG. 7 is different from that in FIG. 3 only in the output of the stop instruction. The remaining components are the same, and a description thereof will not be repeated.

Figure 9:
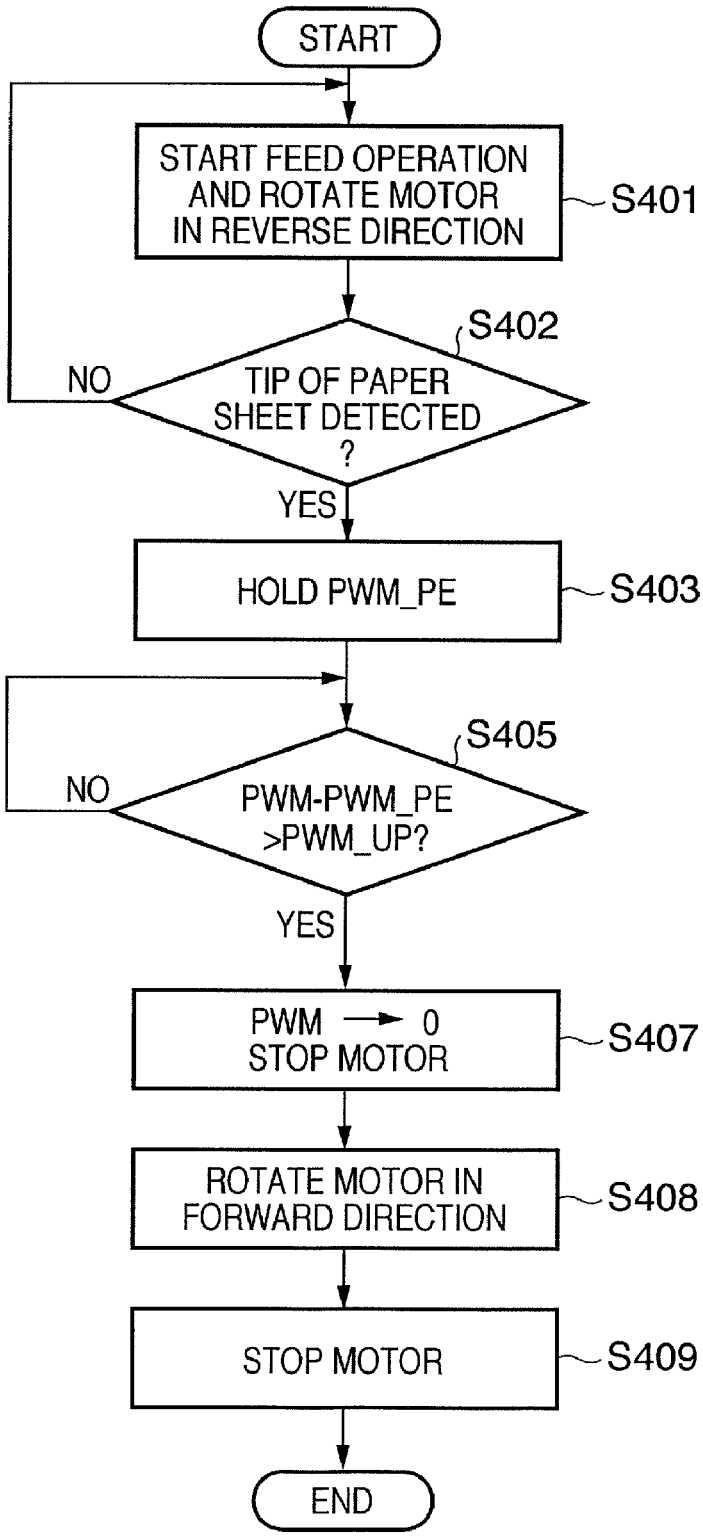
FIG. 9 is a flowchart illustrating another motor control executed by a CPU/G.A.

It should be noted that, when the PWM signal output upon tip detection has a sufficient margin to the upper limit value, the processes. (S404 and S406) shown in FIG. 4 are unnecessary. In this case, control may be performed as shown in FIG. 9. The process flow shown in FIG. 9 excludes steps S404 and S406 in FIG. 4 described above. The difference between FIG. 9 and FIG. 4 will be explained.

In step S403, the PWM signal value after tip(leading edge) detection is held. In step S405, the difference between the PWM signal value and the PWM signal value held in step S403 is monitored. If the difference exceeds the threshold value PWM_UP (YES), it is regarded (determined) that a printing medium has abut against the conveyance roller. Then, the process advances to step S407, and in step S407 the motor is stopped on the basis of the determination. If the difference is equal to/less than the threshold value PWM_UP, monitoring is continued in step S405.

In control shown in FIG. 9, the stop determination unit 305 does not use the speed information from the encoder 2.

Figure 11:
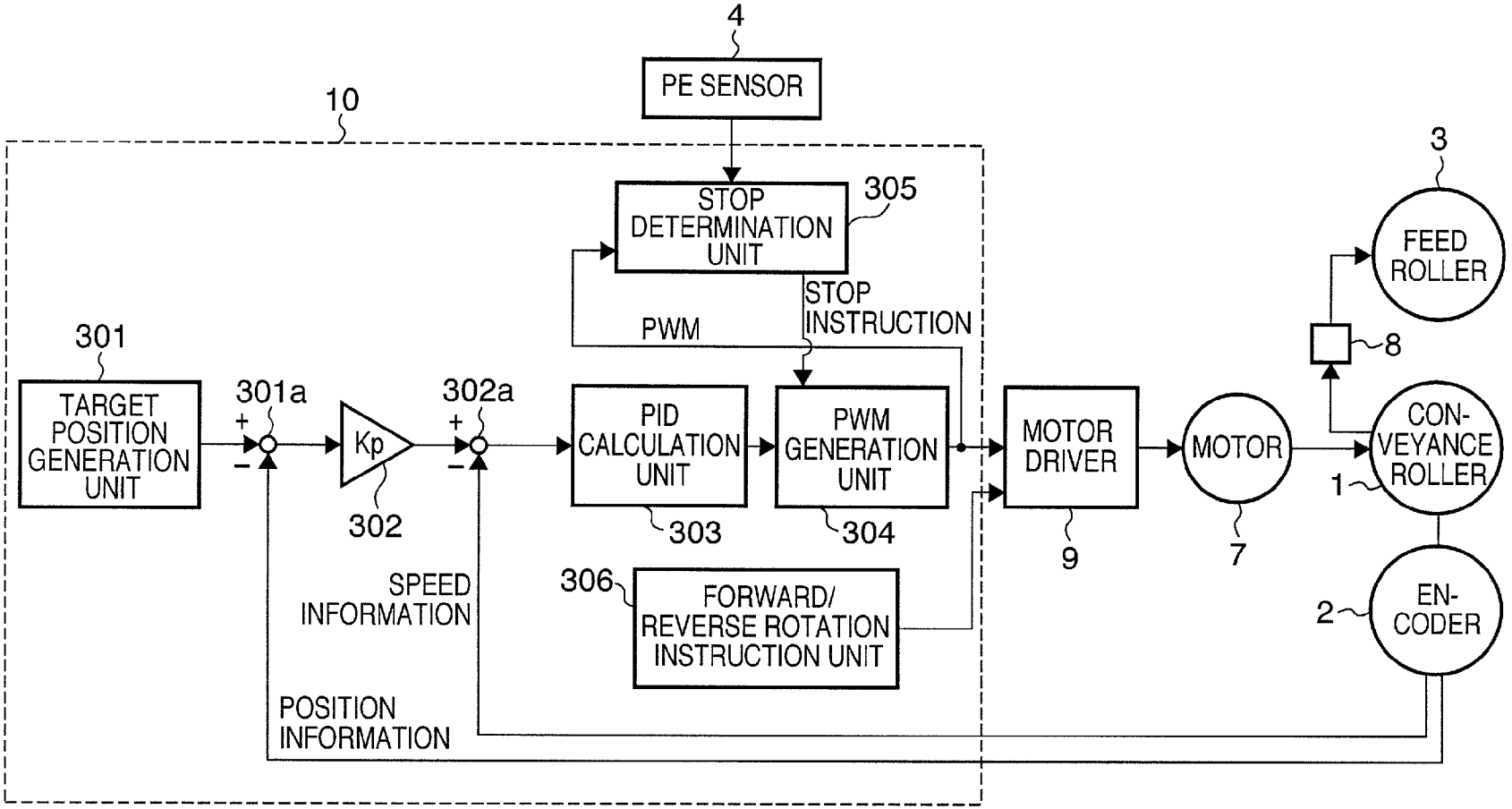
FIG. 11 is a block diagram showing still another embodiment of the functional arrangement of servo control of a motor that drives a conveyance roller and a feed roller.

FIG. 11 is a block diagram showing the functional arrangement of servo control of a motor that drives a conveyance roller and a feed roller in connection with the control flow shown in FIG. 9. Note that the arrangement in FIG. 11 is quite similar to that in FIG. 3. The same components in FIG. 11 as those in FIG. 3 have the same reference numerals as those in FIG. 3. Therefore, the description thereof is not repeated. Only a feature specific to FIG. 11 will be described.

The stop determination unit 305 outputs a stop instruction by using a PWM value generated by the PWM generation unit 304. FIG. 11 is different from FIG. 3 only in this point, and the remaining points are the same.

In the above-described embodiment, the feed roller and conveyance roller are driven by a single motor. However, the printing apparatus may have two motors to separately drive the two rollers.

Figure 12:
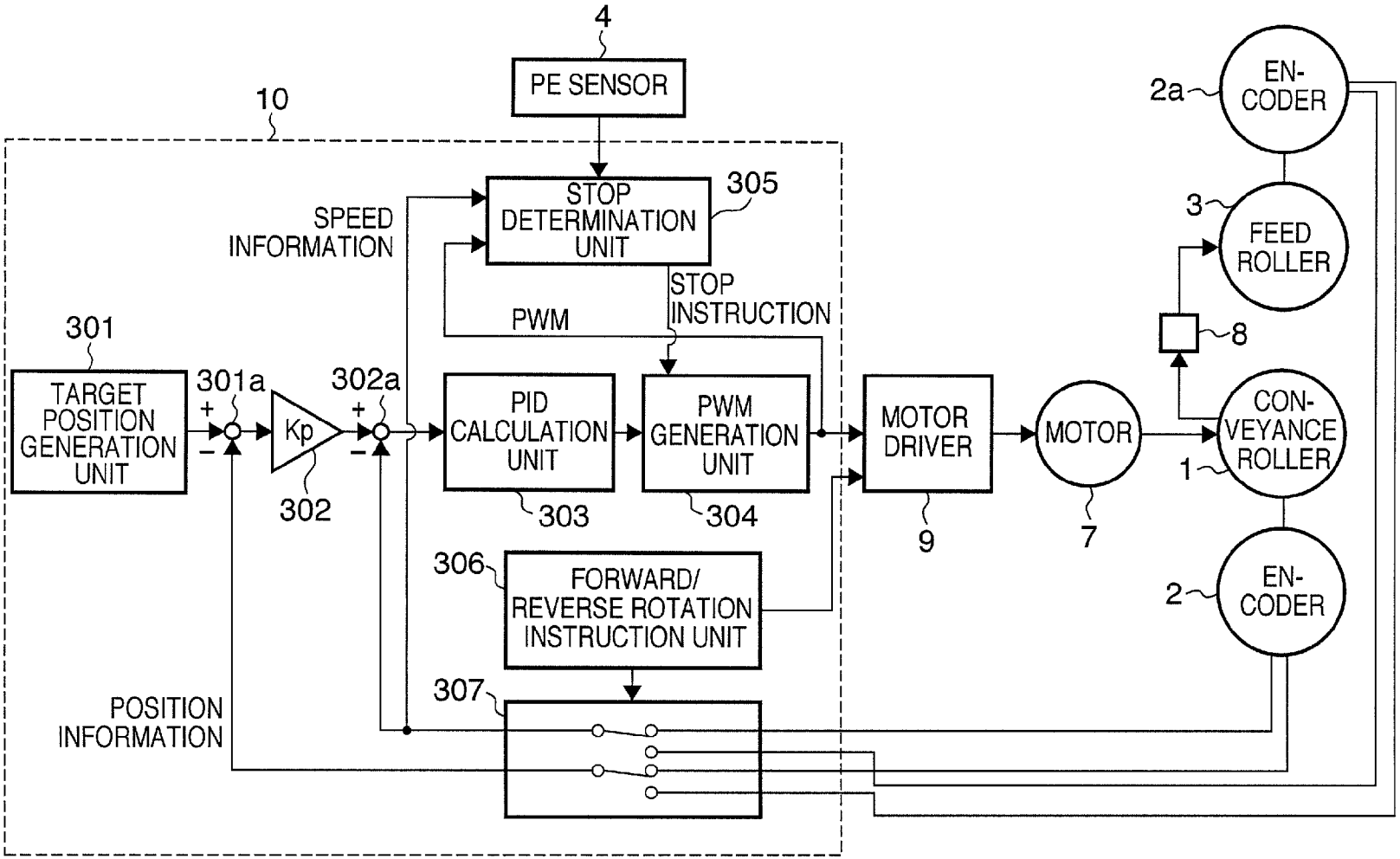
FIG. 12 is a block diagram showing still another embodiment of the functional arrangement of servo control of a motor that drives a conveyance roller and a feed roller.

In the above-described embodiment, the encoder is provided on the conveyance roller 1. Instead, an encoder 2*a* for the feed roller may be provided in addition to the encoder 2 for the conveyance roller 1, as shown in FIG. 12. In this arrangement, a signal switch 307 for selecting an encoder signal on the basis of an instruction from the forward/reverse rotation instruction unit 306 is provided in the CPU/G.A. 10.

In this arrangement, the position information and speed information of the encoder 2 are selected to control the conveyance roller, while the position information and speed information of the encoder 2*a* are selected to control the feed roller.

In the above-described embodiment, the upper limit value (PWM_MAX) of the PWM value is 100%. However, the present invention is not limited to this value.

In the above-described embodiment, droplets discharged from the printhead are ink droplets, and the liquid stored in the ink tank is ink. However, the liquid stored is not limited to ink. For example, a kind of processed liquid which is discharged to a printing medium to increase the fixing properties and water repellency of a printed image or increase the image quality may be stored in the ink tank.

In the above-described embodiment, particularly, of inkjet printing methods, a method utilizing means (e.g., an electrothermal transducer or laser beam) for generating heat energy as energy utilized to discharge ink is employed. When the ink state is changed by the heat energy, the printing density and resolution can be increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-186977, filed Jul. 6, 2006, which is hereby incorporated by reference herein in its entirety.

What is claimed is:

1. A printing apparatus which feeds a stacked printing medium, conveys the printing medium to a print start position, and causes a printhead to print on the printing medium, comprising:

a first roller which feeds the printing medium from a stacking position of the printing medium into the apparatus;

a second roller which further conveys the printing medium fed by said first roller to the print start position;

a DC motor which supplies a driving force to said first roller and said second roller;

an encoder which detects a rotation amount and rotational speed of said first roller;

a sensor, provided at a predetermined position along a feed-conveyance path of the printing medium, for detecting a tip of the printing medium;

generation means for generating a PWM signal by feeding back the rotation amount and rotational speed detected by said encoder;

driving means for driving said DC motor by receiving the PWM signal;

first monitor means for monitoring that a value of the PWM signal becomes larger than a predetermined value with respect to the value of the PWM signal obtained at a timing when said sensor detects the tip of the fed printing medium; and control means for controlling to stop driving said DC motor on the basis of a monitor result of said first monitor means.

2. The apparatus according to claim 1, further comprising:

comparison means for comparing a maximum output value of the PWM signal with a sum of a predetermined value and the value of the PWM signal obtained at the timing when said sensor detects the tip of the fed printing medium; and second monitor means for monitoring that the rotational speed becomes less than a predetermined threshold value, wherein said control means controls to stop driving said DC motor on the basis of the monitor result of said first monitor means in a case where the sum is smaller than the maximum output value, and controls to stop driving said DC motor on the basis of a monitor result of said second monitor means in a case where the sum is equal to/greater than the maximum output value.

3. The apparatus according to claim 1, further comprising:

instruction means for instructing to rotate said DC motor in one of a forward direction and a reverse direction; and driving force transmission means for transmitting the driving force of said DC motor to said first roller and said second roller when said instruction means instructs to rotate said DC motor in the reverse direction, and transmitting the driving force of said DC motor to said second roller when said instruction means instructs to rotate said DC motor in the forward direction.

4. The apparatus according to claim 3, wherein said driving force transmission means includes a pendulum gear.

5. The apparatus according to claim 3, wherein said control means controls said instruction means to rotate said DC motor in the reverse direction at a start of feed of the printing medium, and after driving of said DC motor stops, said control means further controls said instruction means to rotate said DC motor in the forward direction to convey the printing medium to the print start position.

6. The apparatus according to claim 1, further comprising storage means for temporarily storing the value of the PWM signal when the tip of the fed printing medium is detected.

7. The apparatus according to claim 1, wherein said control means issues a stop instruction to stop driving said DC motor, to one of a PWM signal generation unit that generates the PWM signal and a motor driver that drives said DC motor.

8. The apparatus according to claim 7, wherein said encoder includes a rotary encoder attached to said second roller.

9. A conveyance apparatus which feeds a stacked printing medium and conveys the printing medium to a predetermined first position, comprising:

a first roller which feeds the printing medium from a stacking position of the printing medium into the apparatus;

a second roller which conveys the printing medium fed by said first roller to the first position;

a DC motor which supplies a driving force to said first roller and said second roller;

an encoder which detects a rotation amount and rotational speed of said first roller;

a sensor, provided at a second position along a feed-conveyance path of the printing medium, for detecting a tip of the printing medium;

generation means for generating a PWM signal by feeding back the rotation amount and rotational speed detected by said encoder;

driving means for driving said DC motor by receiving the PWM signal;

monitor means for monitoring that a value of the PWM signal becomes larger than a predetermined value with respect to the value of the PWM signal obtained at a timing when said sensor detects the tip of the fed printing medium; and control means for controlling to stop driving said DC motor on the basis of a monitor result of said monitor means.

10. A method of feeding a printing medium of stacked printing media from a stacked position via a first roller to which a driving force is supplied from a DC motor, and further conveying the printing medium fed by the first roller into a predetermined first position via a second roller to which a driving force is supplied from the DC motor, comprising:

a first detection step of detecting a rotation amount and rotational speed of the first roller by using an encoder;

a second detection step of detecting a tip of the printing medium by using a sensor provided at a second position along a feed-conveyance path of the printing medium;

a generation step of generating a PWM signal by feeding back the rotation amount and rotational speed of the first roller detected by the encoder;

a driving step of driving said DC motor by receiving the PWM signal;

a monitor step of monitoring that a value of the PWM signal becomes larger than a predetermined value with respect to the value of the PWM signal obtained at a timing when said sensor detects the tip of the fed printing medium; and a control step of controlling to stop driving the DC motor on the basis of a monitor result in the monitor step.

* * * * *